US005117916A

United States Patent [19]

Ohta et al.

[11] Patent Number: 5,117,916

[45] Date of Patent: Jun. 2, 1992

[54] SPRINKLER HEAD AND OPERATION MONITOR THEREFOR

[75] Inventors: Tomohiro Ohta, Yokohama; Takahiro Nakajima, Sagamihara, both of Japan

[73] Assignee: Hochiki Kabushiki Kaisha, Tokyo, Japan

[21] Appl. No.: 682,664

[22] Filed: Apr. 9, 1991

[30] Foreign Application Priority Data

Apr. 11, 1990 [JP] Japan ..... 1-95349
Apr. 19, 1990 [JP] Japan ..... 1-104186

[51] Int. Cl.[5] ..... A62C 37/08; A62C 37/11; A62C 37/21; A62C 35/62

[52] U.S. Cl. ..... 169/37; 169/17; 169/23; 169/61

[58] Field of Search ..... 169/37, 23, 61, 17

[56] References Cited

U.S. PATENT DOCUMENTS

| | | | |
|---|---|---|---|
| 712,693 | 11/1902 | Linn | 169/37 |
| 2,038,619 | 4/1936 | Watson | 169/37 |
| 2,890,758 | 6/1959 | Pfalzgraff et al. | 169/37 |
| 3,727,695 | 4/1973 | Danton | 169/37 |
| 3,988,273 | 12/1976 | Juliano | 169/37 |
| 4,014,388 | 3/1977 | Anderson | 169/37 |
| 4,066,129 | 1/1978 | Anderson | 169/37 |
| 4,880,063 | 11/1989 | Leininger et al. | 169/37 |
| 4,926,946 | 5/1990 | Polar | 169/37 |
| 5,020,601 | 6/1991 | Retzloff et al. | 169/37 |

FOREIGN PATENT DOCUMENTS

| | | | |
|---|---|---|---|
| 2752128 | 6/1978 | Fed. Rep. of Germany | 169/37 |
| 11700 | 1/1977 | Japan | 169/37 |
| 58297 | 5/1977 | Japan | 169/37 |
| 65998 | 5/1977 | Japan | 169/37 |
| 1459668 | 2/1989 | U.S.S.R. | 169/37 |
| 152938 | 10/1920 | United Kingdom | 169/37 |

*Primary Examiner*—Margaret A. Focarino
*Assistant Examiner*—James M. Kannofsky

[57] ABSTRACT

A sprinkler head of the present invention comprises a cover plate which is operated to fall down at a temperature lower than the operating temperature of the sprinkler head body and a switching unit provided on the body side of the sprinkler head so as to detect the falling of the cover plate and send a fire detection signal.

A sprinkler head comprises a switching unit provided on the side of the sprinkler head body so as to send a fire detection signal when the unit is operated at a temperature lower than the operating temperature of the sprinkler head and send a sprinkler head operation signal when it is returned to a non-operating state by detection of the firewater discharged by the operation of the sprinkler head after the fire detection signal has been sent.

An operation monitor for the sprinkler head of the present invention decides that the sprinkler head is operated and indicates the operation when it receives a sprinkler head operation signal from a switching unit provided on the sprinkler head and a detection signal from a water flow detector provided on piping extending to the sprinkler head.

The structure in which the sprinkler head also serves as a fire detector enables a reduction of the cost of fire extinguishing equipment and the simplification of the installation work thereof, as well as an improvement in the appearance. It is also possible to detect the discharge of water from the sprinkler head without giving false information.

6 Claims, 9 Drawing Sheets

A-A SECTION

EXTINGUISHING

OPERATION

FIRE

NORMAL CONDITION

SPRINKLER HEAD AND OPERATION MONITOR THEREFOR

BACKGROUND OF THE INVENTION

The present invention relates to a sprinkler head which is operated due to the heat generated by a fire for sprinkling firewater and an operation monitor therefor, and particularly to a sprinkler head provided with the function as a fire detector.

Fire extinguishing equipment having a sprinkler head and fire alarm equipment having a fire detector are generally provided in completely separate portions.

Namely, when such fire extinguishing equipment provided with a sprinkler head and such fire alarm equipment are installed, the sprinkler head and the fire detector must be installed by separate works. Thus the equipment cost is high, and the installation work is troublesome. In addition, since both the detector and the sprinkler head are provided on the surface of a ceiling, the appearance deteriorates.

There is also the problem that it is impossible to make certain whether or not firewater is actually discharged from the sprinkler head which is operated by a fire.

SUMMARY OF THE INVENTION

The present invention has been achieved in consideration of the above-described problems of prior art, and it is an object of the present invention to provide a sprinkler head and an operation monitor for the sprinkler head which is provided with the function as a fire detector and which enables the ascertainment of the operating state where fire water is actually discharged.

To this end, the present invention provides a sprinkler head comprising a cover plate which is operated to fall at a temperature lower than the operating temperature of the body of the sprinkler head, i.e., a con-shield-type sprinkler head, wherein the body of the sprinkler head is provided with switching means, for example, a microswitch, for detecting the falling of the cover plate and sending a fire detection signal.

The sprinkler head of the present invention configured as described above allows the cover plate to be first operated so as to fall when detecting the heat generated by a fire. When the cover plate falls down, the microswitch which is, for example, turned off in a state where it is mounted, is turned on and sends a fire detection signal. The sprinkler head therefore also serves as a fire detector, without the need for separately providing a fire detector. It is therefore unnecessary to install both the sprinkler head and the fire detector on a ceiling, and the wiring therefor can be collected to one cable. The sprinkler head of the present invention is thus useful from the viewpoints of its equipment cost and installation work, and it is preferable from the viewpoint of its beautiful appearance.

In another preferred form of the sprinkler head of the invention, the body of the sprinkler head is provided with switching means which is operated at a temperature lower than the operating temperature of the sprinkler head so as to send a fire detection signal and which is returned to a non-operating state so as to send a sprinkler head operation signal when it is splashed with the firewater discharged by the operation of the sprinkler head after the fire detection signal has been send.

An operation monitor for the sprinkler head of the present invention is arranged so as to decide that the sprinkler head is operated and send an alarm when a sprinkler head operation signal is output from the switching means and when a detection signal is output from the water flow detector provided in the piping for the sprinkler head.

The sprinkler head of the present invention configured as described above is provided with the switching means which has a low operating temperature and which is turned on and sends the fire detection signal when detecting the heat generated by a fire.

It is therefore unnecessary to separately install a fire detector, like the above-described arrangement. The sprinkler head of the present invention is thus useful from the viewpoints of its equipment cost and installation work, and is preferable from the viewpoint of its beautiful appearance.

In this case, when the sprinkler head is operated so as to discharge firewater, the switching means is splashed with the firewater and thus cooled. When the switching means is cooled, it is returned to a non-operating state, for example, a switch-off state. Namely, the switch-off signal can be used as a sprinkler head operation signal. When the sprinkler head is mistakenly operated by a temperature rise which is produced by a cause other than a fire, in order to prevent false information from being sent by the sprinkler head operation signal generated from the switching means cooled, the logical product (AND) of the sprinkler head operation signal and the water flow detection signal from the water flow detector is made for deciding that the sprinkler head is operated and indicating the operation thereof. This enables the attainment of high reliability for information.

DESCRIPTION OF PREFERRED EMBODIMENT OF THE INVENTION

Figure 1:
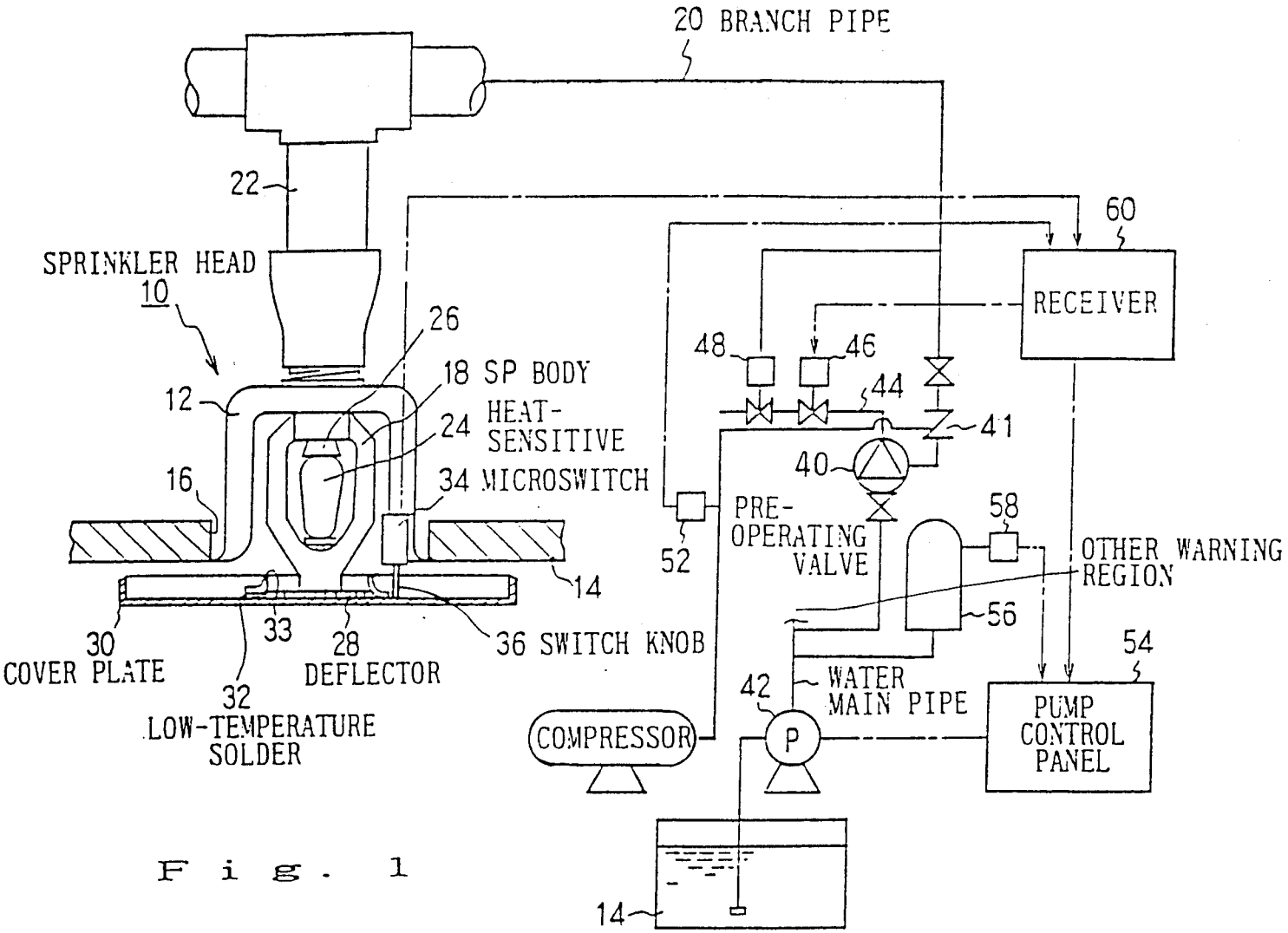
FIG. 1 is a drawing showing the arrangement of a first embodiment of the present invention together with pre-operating sprinkler equipment.

FIG. 1 is a drawing of the arrangement of a sprinkler head in accordance with a first embodiment of the present invention together with pre-operating sprinkler equipment.

In FIG. 1, reference numeral 10 denotes a sprinkler head which is fitted in a mounting hole 16 formed in a ceiling 14. The upper portion of the sprinkler head body 18 is screwed into the end of a down pipe 22 connected to a branch pipe 20 for supplying water. A heat-sensitive disassemblable portion 24 is incorporated into the central portion of the sprinkler head body 8 so as to support an upper gasket (valve member) 26 and close an outlet (not shown). In this embodiment, the heat-sensitive disassemblable portion 24 comprises a quick-acting heat-sensitive disassemblable portion having a glass tube in which a liquid is sealed so that the glass tube is broken due to the expansion of the liquid at a predetermined operating temperature, which is caused by a temperature rise during a fire. The operating temperature of the quick-acting heat-sensitive disassemblable portion 24 can be adjusted by changing the type or volume of the liquid sealed. In this embodiment, the operating temperature is set to, for example, 74° C.

A deflector 28 is fixed to the lower end of the sprinkler head 18, a dish-like cover plate 30 being attached to the lower side of the deflector 28. Namely, as shown in the partially enlarged sectional view in FIG. 2, substantially L-shaped synthetic resin pieces 33 are respectively fixed by low-temperature solder 32 at three positions on the inside of the cover plate 30, with a spring plate 35 between each of the resin pieces 33 and the cover plate 30. The synthetic resin pieces 33 are engaged with the deflector 28 so that the cover plate 30 is attached to the deflector 28. The operating temperature (melting temperature) of the low temperature solder 32 is set to a temperature lower than the operating temperature of the side of the sprinkler head body 18, i.e., the operating temperature of the heat-sensitive disassemblable portion 24. For example, if the operating temperature of the heat-sensitive assembling portion 24 is 74° C., the operating temperature of the low-temperature solder 32 is set to 68° C.

In the sprinkler head 10 of the present invention comprising the cover plate 30, a microswitch 34 is provided on a bracket 12, as shown in a lower right portion of the bracket 12 in FIG. 1. A switch knob 36 extends from the top of the microswitch 34 to the inner side of the cover plate 30 so as to be inwardly pushed toward the side of the microswitch 34 and turn the switch contact therein off in the assembly state shown in FIG. 1. In this state, when the low-temperature solder 32 is molten by the heat generated by a fire and when the plate 30 falls down by gravity, the switch knob 36 is released from the engagement with the cover plate 30 and downwardly projects so that the switch contact contained in the microswitch 34 is turned on, and the fire detection signal is output to a receiver 60.

A description will now be given of pre-operating sprinkler equipment which comprises the sprinkler head 10 of the present invention.

As shown in FIG. 1, a pre-operating valve 40 is provided on the branch pipe 20 connected to the sprinkler head 10, a primary side of the pre-operating valve 40 being connected to a fire pump 42. A low-pressure starting piping 44 is provided on the pre-operating valve 40, the low-pressure starting piping 44 comprises a solenoid valve 46 and a low-pressure operating pilot valve 48, both of which are provided in series.

Compressed air is sent to the secondary side of the pre-operating valve 40 from a compressor 50 through a check valve 41. In a steady monitor state, the compressed air is sealed in the branch pipe 20 on the secondary side of the pre-operating valve 40. A pressure switch 52 for detecting a pressure reduction is provided in the piping from the compressor 50 so as to output a pressure reduction alarm which shows the breakage of the piping on the basis of the switch-on signal generated by the pressure reduction.

The operation of a fire pump 42 is controlled by a pump control panel 54 so as to supply under pressure firewater from a water source 14. The pump control panel 54 starts the fire pump 42 when receiving a pressure reduction detection signal from the pump starting pressure switch 58 of a pressure tank 56 provided on the discharge side of the pump.

On the other hand, the fire detection signal generated from the microswitch 34 which is provided on the sprinkler head 10 of the present invention is sent to the receiver 60. When the receiver 60 receives the fire detection signal output from the microswitch 34 provided on the sprinkler head 10, the receiver 60 sends a fire alarm and outputs a starting signal to the solenoid valve 46 provided on the low-pressure starting piping 44 of the pre-operating valve 40 so as to open the solenoid valve 46. At the same time, if required, the receiver 60 sends a signal to the pump control panel 54 so that the operation of the fire pump 42 can be stopped.

Figure 2:
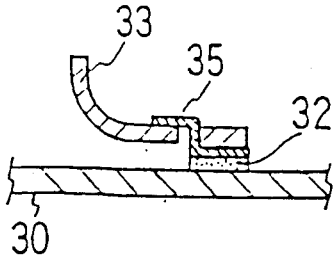
FIGS. 2 to 5 are partially enlarged sectional views showing the portion where a cover plate is engaged wit a deflector.

The operation of the embodiment shown in FIGS. 1 and 2 is described below with reference to the operating flowchart shown in FIG. 6.

If a fire breaks out, the sprinkler head 10 first detects the heat generated by the fire in Step 1 (referred to as "S1" hereinafter). The low-temperature solder 32 of each of the synthetic resin pieces 33 for attaching the cover plate 30 to the deflector 28 is molten at the operating temperature, and the cover plate 30 falls down, as shown in S2. The falling of the cover plate 30 causes the switch knob 36 of the microswitch 34 to be released from engagement in a switch-off state. In S3, the switch contact of the microswitch 34, i.e., the alarm contact, is actuated so that the fire detection signal is output to the receiver 60. When the receiver 60 receives the fire detection signal, the receiver 60 sends a fire alarm in S4. At this time, the receiver 60 outputs a starting signal to the solenoid valve 46 provided on the low-pressure starting piping 44 of the pre-operating valve 40 so as to open the solenoid valve in S5.

The falling of the cover plate 30 accelerates the temperature rise in the heat-sensitive disassemblable portion 24 of the sprinkler head 20. When the temperature reaches a predetermined operating temperature, the heat-sensitive disassemblable portion 24 breaks by itself, and the sprinkler head 10 is actuated by the release from the holding of the gasket 26 in S6.

Figure 6:
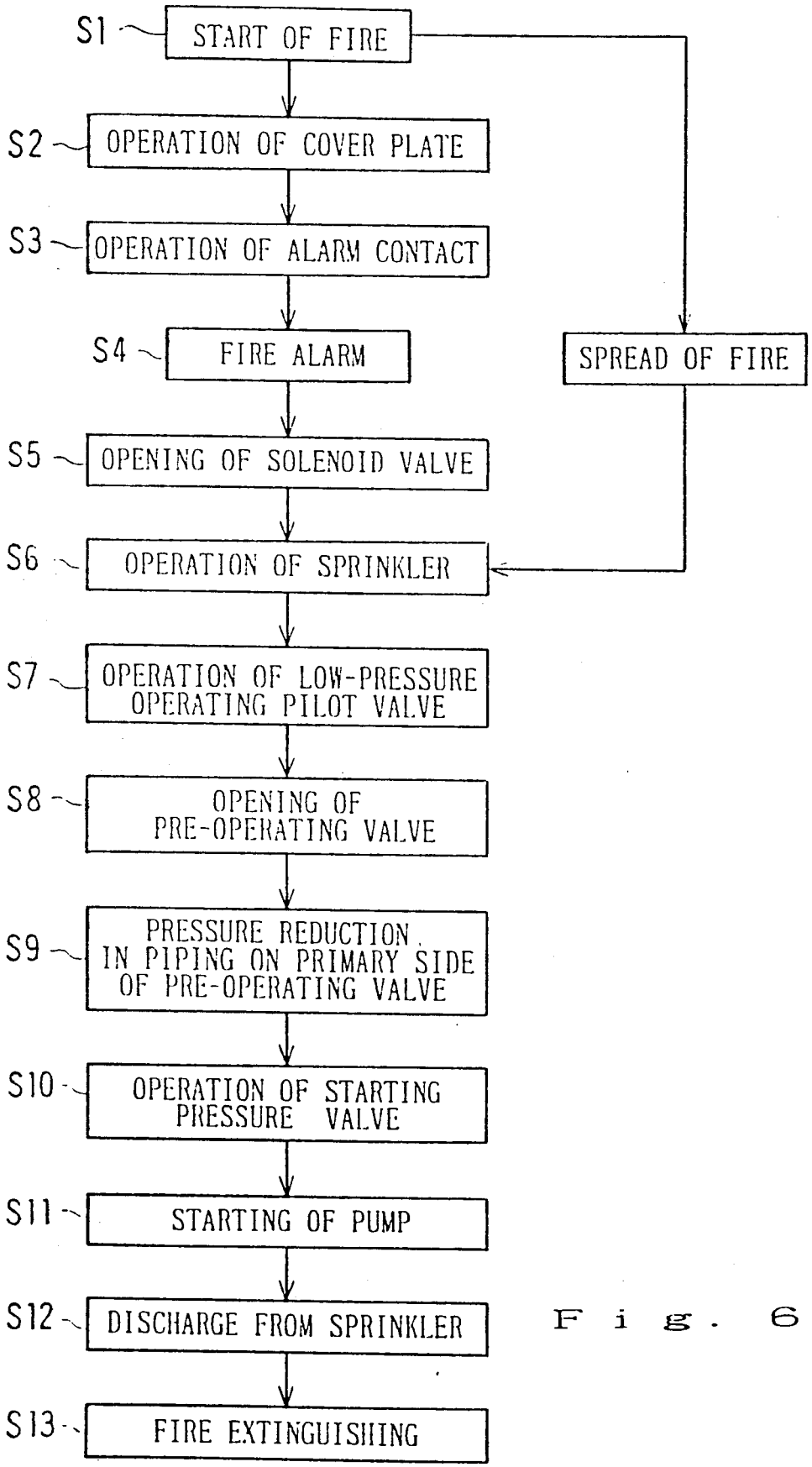
FIG. 6 is a flowchart showing the operation of the first embodiment.

The operation moves from S1 to S6 accompanying the spread of the fire, as shown in parallel with the flowchart in FIG. 6.

On the other hand, in the sprinkler equipment, when the sprinkler head 10 is actuated in S6, the compressed air sealed in the branch pipe 20 is discharged, and the low-pressure operating pilot valve 48 is opened when detecting the pressure reduction in the branch pipe 20 in S7. At the same time, the low-pressure starting piping 44 is opened because the solenoid valve 46 has already been opened by the starting signal output from the receiver 60. The opening of the low-pressure starting piping 44 causes the pre-operating valve 40 to be opened in S8.

This system in which the operation of the pre-operating valve 40 is inhibited by two valve, i.e., the solenoid valve 46 and the low-pressure operating pilot valve 48, is generally known as "double interlock system".

When the pre-operating valve 40 is opened in S8, the pressure in the piping on the primary side extending to the fire pump 42 is reduced, as shown in S9. Since the pressure in the pressure tank 56 is also reduced at the same time as the pressure reduction in the piping, the starting pressure switch 58 provided on the pressure tank 56 is actuated in S10, and the pump control panel 54 starts the fire pump 42 in S11. The fire pump 42 supplies the firewater under pressure from the water source 14. The firewater is thus supplied to the branch pipe 20 through the pre-operating valve 40 and sprinkled from the sprinkler head 10 which has already been opened in S6 for extinguishing the fire.

As described above, in the present invention, the provision of the switch means for detecting the falling of the cover plate and sending a fire detection signal permits the fire detection signal to be sent by installing only the sprinkler head, without separately installing a detector. This causes a reduction in the equipment cost and facilitates the installation work. In addition, since there is no need for separately installing a detector, the present invention is preferable from the viewpoint of appearance.

Although the heat-sensitive disassemblable portion 24 comprises a quick-acting disassemblable portion having the glass tube in which a liquid is sealed, it is a matter of course that the sprinkler head may have a heat-sensitive disassemblable portion having a mechanical rink kept in a closed state by solder fixing.

Although FIGS. 1 and 2 show as an example pre-operating sprinkler equipment in which the pre-operating valve is opened on the basis of the fire detection signal output from the sprinkler head 10 and the pressure reduction of the piping connected to the sprinkler head 10 so that the fire pump is started for supplying the firewater under pressure, the present invention can be used as means for detecting a fire in appropriate sprinkler equipment which comprises another closed-type sprinkler head.

Figure 3:
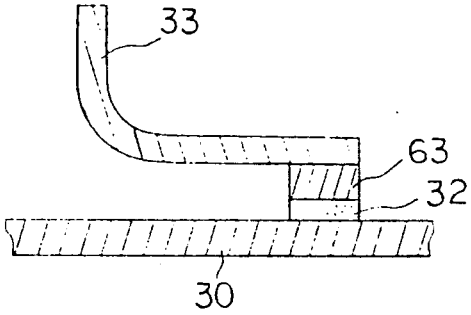

FIG. 3 is a partially enlarged sectional view showing another embodiment of the portion where the cover plate 30 is engaged with the deflector 28.

Figure 4:
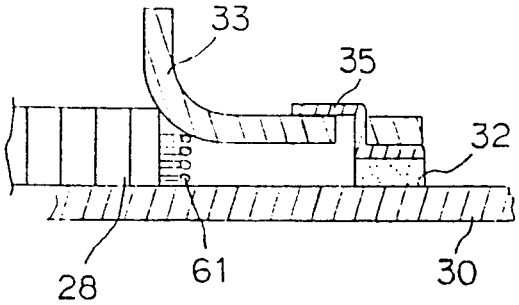

In this embodiment, a synthetic resin piece 33 is fitted to the cover plate 30 through a metal plate 63. In this case, the synthetic resin piece 33 is bonded to the metal plate 63 by a heat-resistant adhesive. The metal plate 63 is bonded to the cover plate 30 by low-temperature solder. This method enables the omission of the spring plate 35 which must be bent for attaching the synthetic resin piece 33 to the cover plate 30 and the omission of the process of engaging the synthetic resin piece 33 with the spring plate 35, thereby improving the workability. FIG. 4 is a partially enlarged sectional view of still another embodiment of the portion where the cover plate 30 is engaged with the deflector 28.

In this embodiment, a compression spring 61 urged in the direction in which the cover plate 30 is separated from the deflector 28 is interposed between the synthetic resin piece 3 and the cover plate 30 so as to abut on the piece 33 and the cover plate 30. In this case, when the low-temperature solder 32 is molten by a temperature rise, the cover plate 30 is forced to separate from the defector 28 by the urging force of the compression spring 61. The cover plate 30 can be surely caused to fall by a temperature rise.

Figure 5:
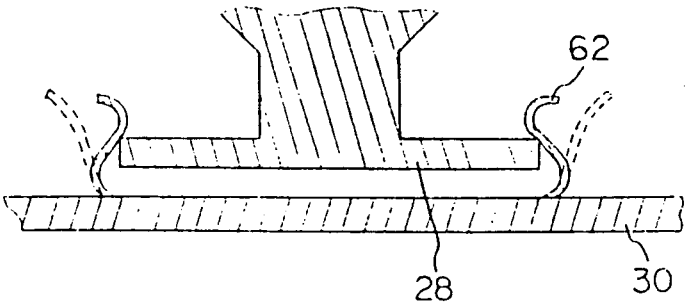

FIG. 5 is a partially enlarged sectional view showing a further embodiment of the portion where the cover plate 30 is engaged with the deflector 28.

In this embodiment, the cover plate 30 is engaged with the deflector 28 by engaging pieces 62 made of a shape memory alloy. In this case, the deflector 28 is fitted beyond the convex portion **62*a* of each of the engaging pieces 62 against the elastic force thereof. Each of the engaging pieces 62 is made of a shape memory alloy which is subjected to memory treatment so as to be deformed at a predetermined temperature, for example, 68° C., as shown by a dotted line in FIG. 5. When the temperature of the engaging piece 62 is increased by a fire, therefore, the engaging pieces 62 are deformed into the shape shown by the dotted line so that the cover plate 30** falls down by gravity.

Figure 7:
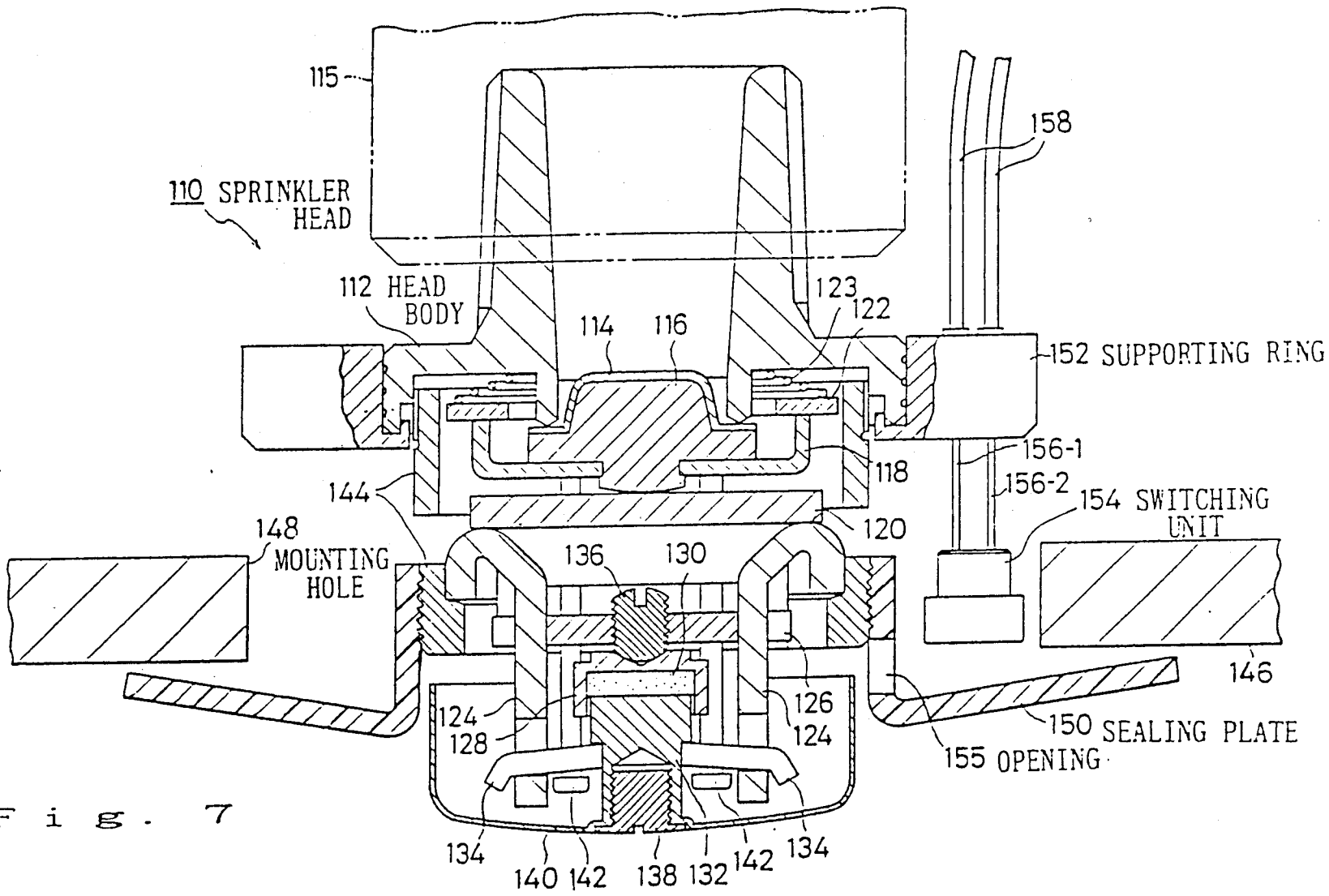
FIG. 7 is a drawing showing the arrangement of a sprinkler head in accordance with a second embodiment of the present invention.

FIG. 7 is a drawing showing the arrangement of a sprinkler head in accordance with a second embodiment of the present invention.

In the sprinkler head 110 shown in FIG. 7, reference numeral 112 denotes a head body which is screwed into a down pipe 115 connected to a branch pipe and fixed therein, like the first embodiment. A valve body 116 is disposed in the opening of the head body 112 through a packing 114, and a deflector 118 is disposed under the valve body 116, with a saddle 120 being provided under the deflector 118. The periphery of the deflector 118 is upwardly bent, and a spring 123 is interposed between the head body 112 and the deflector 118, with a guide ring 122 therebetween.

The ends of the upper bent portions of two levers 124 abut on the lower side of the saddle 120.

Figure 8B:
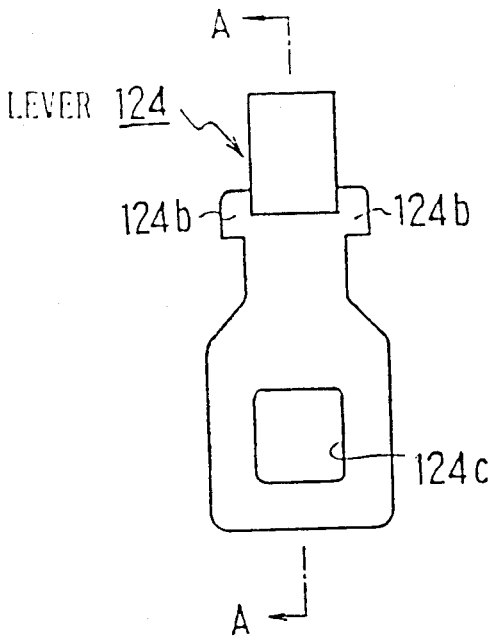
FIGS. 8(*a*) and 8(*b*) are explanatory views of the supporting plate of a sprinkler head.
Figure 8A:
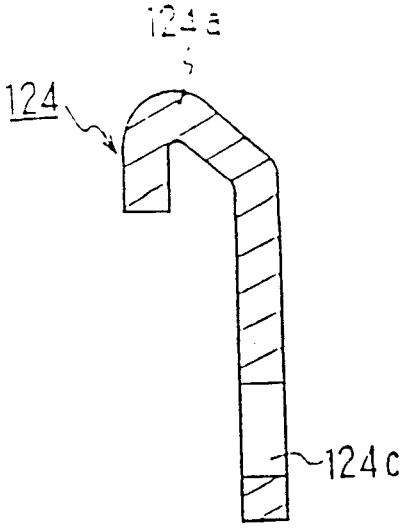

Each of the levers 124 has the shape shown in FIG. 8 and an upper bent portion **124*a* having a top on the outside thereof. Each of the levers 124 also has a projecting portion 124*b* in the side of the upper portion thereof and a rectangular opening 124*c*** formed at the center of the lower portion thereof.

Figure 9:
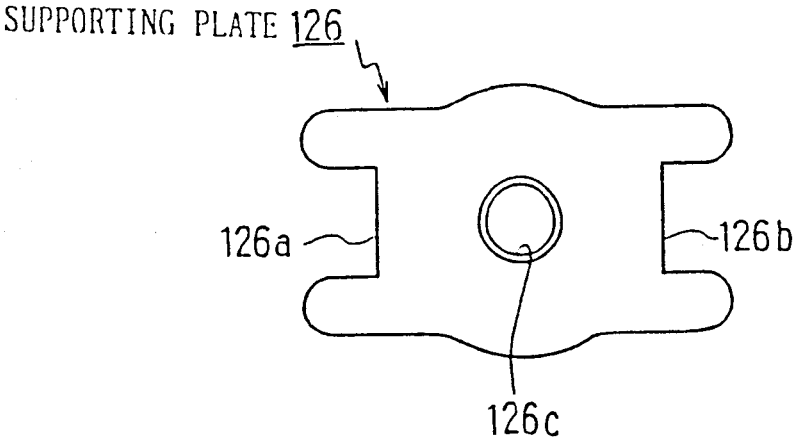
FIG. 9 is an explanatory view of the lever of a sprinkler head.

Referring to FIG. 7, a supporting plate 126 is interposed between the upper portions of the two levers 124. As shown in a plan view of FIG. 9, the supporting plate 126 has a tapped hole **126*a* at the center thereof and right and left rectangular engaging grooves 126*b*. The levers 124 respectively enter the engaging grooves 126*b* from the outside thereof, as shown in FIG. 7. A cylinder 128 is disposed under the supporting plate 126, the end of a plunger 132 being placed in the cylinder 128 through a low-temperature solder 130. Ends of two balances 134 are respectively engaged with the lower stepped portion of the plunger 132 from the both side thereof, the outsides of the balances being respectively fitted in the lower openings 124*c* of the levers 124. A set screw 136 is screwed into the tapped hole of the supporting plate 126 provided above the cylinder 128 so as to be brought into pressure contact with the counterbore formed at the end surface of the cylinder 128**.

A cap-like heat collecting plate 140 is fixed to the lower side of the plunger 132 by a crew 138.

In addition, two guide pins 142 are suspended from the head body 112, the deflector 118 being slidably attached to the guide pins 142.

Figure 10:
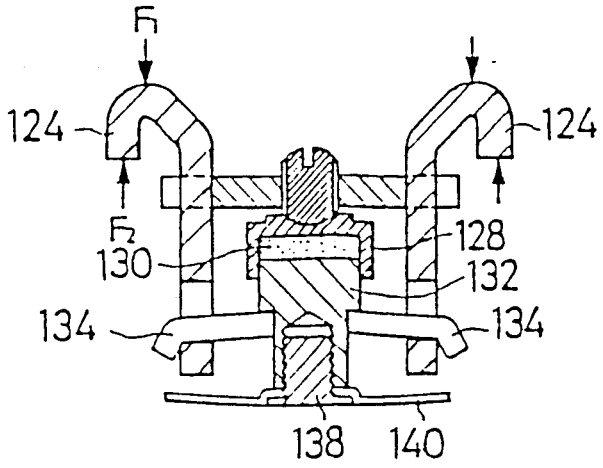
FIG. 10 is an explanatory view of the heat-sensitive disassemblable mechanism of a sprinkler head.
Figure 11D:
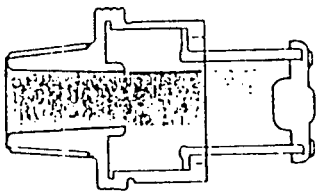
FIGS. 11(*a*) to 11(*d*) are explanatory views showing the operation of a sprinkler head in accordance with the second embodiment of the present invention.
Figure 11C:
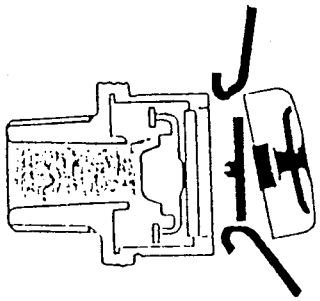
Figure 11B:
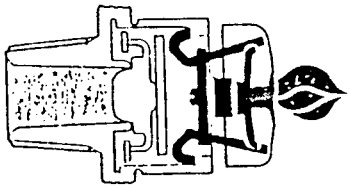
Figure 11A:
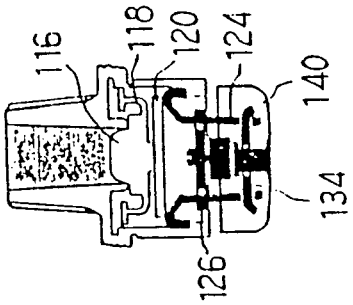

The mechanism structure including the upper packing 114 to the lower heat collecting plate 140 is assembled and fixed by screwing a frame 144 into the lower portion of the head body 112. The assembly loads F1 and F2 shown in FIG. 10 act on the levers 124 which are brought into contact with the saddle 120 at the ends thereof by the assembly load of the frame 143 caused by the head body 112. Namely, the downward assembly load F1 acts on the bent upper end of the levers, and the upward assembly load F2 acts outside the load F1. As a result, the levers 124 are subjected to angular moment which outwardly open the levers 124 and which is stopped by the balances 134 engaged with the plunger 132.

As shown in FIGS. 11(*a*) to 11(*d*), in the sprinkler head 110 of this embodiment, when the heat collecting plate 140 receives the heat generated by a fire, and when the temperature of the low-temperature solder 130 reaches the melting temperature, the low-temperature solder 130 flows out of the gap between the cylinder 128 and the plunger 132 so that the plunger 132 is upwardly moved, thereby releasing the engagement of the balances 134. This causes the balances to be released, and the levers 124 to be released from engagement. The balances 134 and the levers 124 are consequently separated and fall down. At the same time, all the members provided under the saddle 120 fall down (FIG. 11(*c*)).

When the sprinkler head 110 is actuated in the above-described manner, the deflector 118 supported at an upper position by the saddle 120 falls down by virtue of the spring 123 and then supported at the end positions of the guide pins 142. At the same time, the packing 114 and the valve body 116 also fall down, and the opening of the head body 112 is opened for discharging the firewater (FIG. 11(*d*)).

The sprinkler head 110 having the above structure is disposed in such a manner that the tip thereof projects from a mounting hole 148 of a ceiling 146. A sealing plate 150 is attached to the frame 144 for the purpose of sealing the gap between the frame 144 and the mounting hole 148.

In the present invention, a switching unit 154 is supported by the supporting ring 152 fixed at the lower end of the head body 112 at the back of the sealing plate 150. The sealing plate 150 also has an opening 155 formed near the switching unit 154 so that hot air and the firewater is easily applied to the switching unit 154.

A gap is also formed between the sealing plate 150 and the ceiling 146 so that hot air easily enter the gap.

Namely, in this embodiment, the switching unit 154 is operated at a temperature lower than the operating temperature of the sprinkler head 110, i.e., the operating temperature of the low-temperature solder 130, so as to send a fire detection signal. In addition, when the switching unit 154 is cooled with the firewater discharged from the head body 112 after being operated, the switching unit 154 is returned to the original non-operating state. When the switching unit 154 is returned to the non-operating state, a sprinkler head operation signal is output.

The switching unit 154 has two lead terminals 156-1, 156-2 which are led out to the upper portion thereof and which are connected to two signal lines 158 drawn into the supporting ring 152 from the upper portion thereof.

Figure 12:
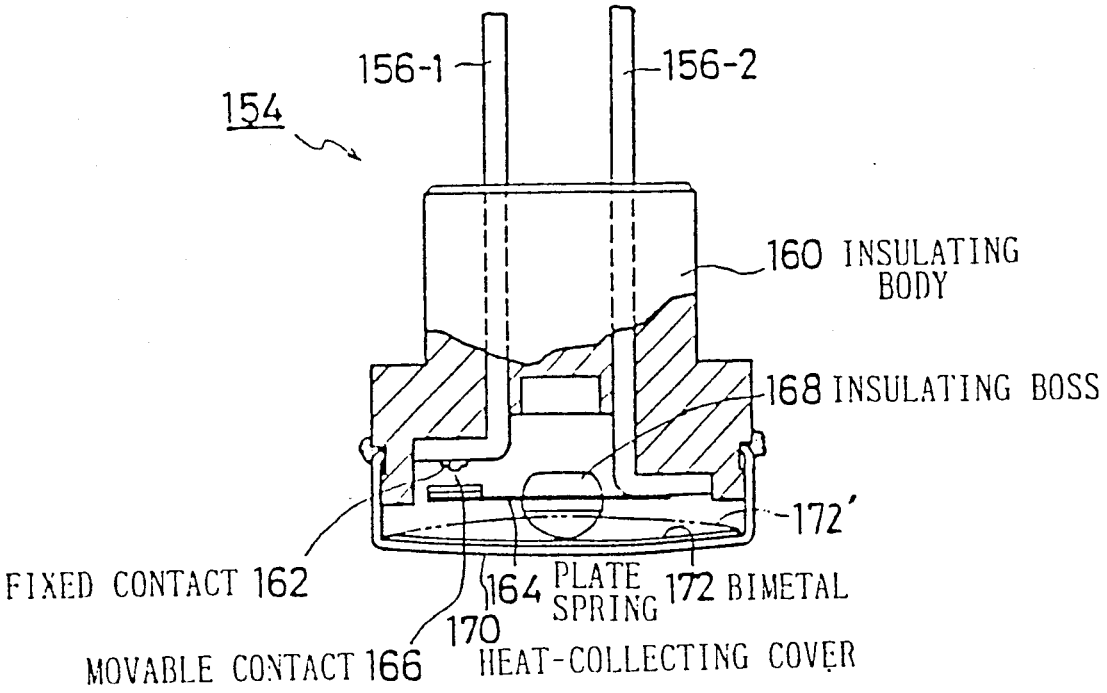
FIG. 12 is a drawing of the arrangement of an embodiment of the switching unit used in the present invention.

FIG. 12 is a sectional view showing an embodiment of the switching unit 154 provided on the sprinkler head 110 shown in FIG. 7.

In FIG. 12, the lead terminals 156-1, 156-2 are led into the insulating body 160 of the switching unit 154 from the upper portion thereof. The end of the lead terminal 156-1 is bent into a L-shape and fixed to form a fixed contact 162. On the other hand, the end of the lead terminal 156-2 is bent into a L-shape and fixed at a position under the fixed contact 162. One end of a plate spring 164 is fixed to the surface of the bent portion provided at the end of the lead terminal 156-2, a movable contact 166 being fixed to the portion at the end of the plate spring 164 opposite to the fixed contact 162.

An insulating boss 168 is mounted at the center of the plate spring 164 so as to press the center of the disc-like bimetal 172 incorporated in a heat collecting cover 170 attached to the lower side of the insulating body 160. Although the bimetal 172 is upwardly curved at the non-operating temperature, as shown in the drawing, when the temperature reaches a predetermined temperature lower than the operating temperature of the sprinkler head, the bimetal 172 is downwardly curved, as shown by 172' in FIG. 12. As a result, the bimetal 172 upwardly pushes the spring plate 164 through the insulating boss 168 and brings the movable contact 166 into contact with the fixed contact 162, thereby turning the switch on.

The bimetal 172 which is reversely curved at the operating temperature, as shown by 172,, is again returned to the original state when the temperature is decreased to a temperature below the operating temperature, whereby the contact between the movable contact 166 and the fixed contact 162 is released for turning the switch off.

The switching unit 154 provided in the sprinkler head 110 shown in FIG. 12 therefore sends as a fire detection signal a switch-on signal at the operating temperature. On the other hand, after the unit 154 sends the fire detection signal, when the unit is cooled by the firewater applied thereto, the switching unit 154 is returned to the non-operating state and sends a switch-off signal as a sprinkler head operating signal.

Figure 13:
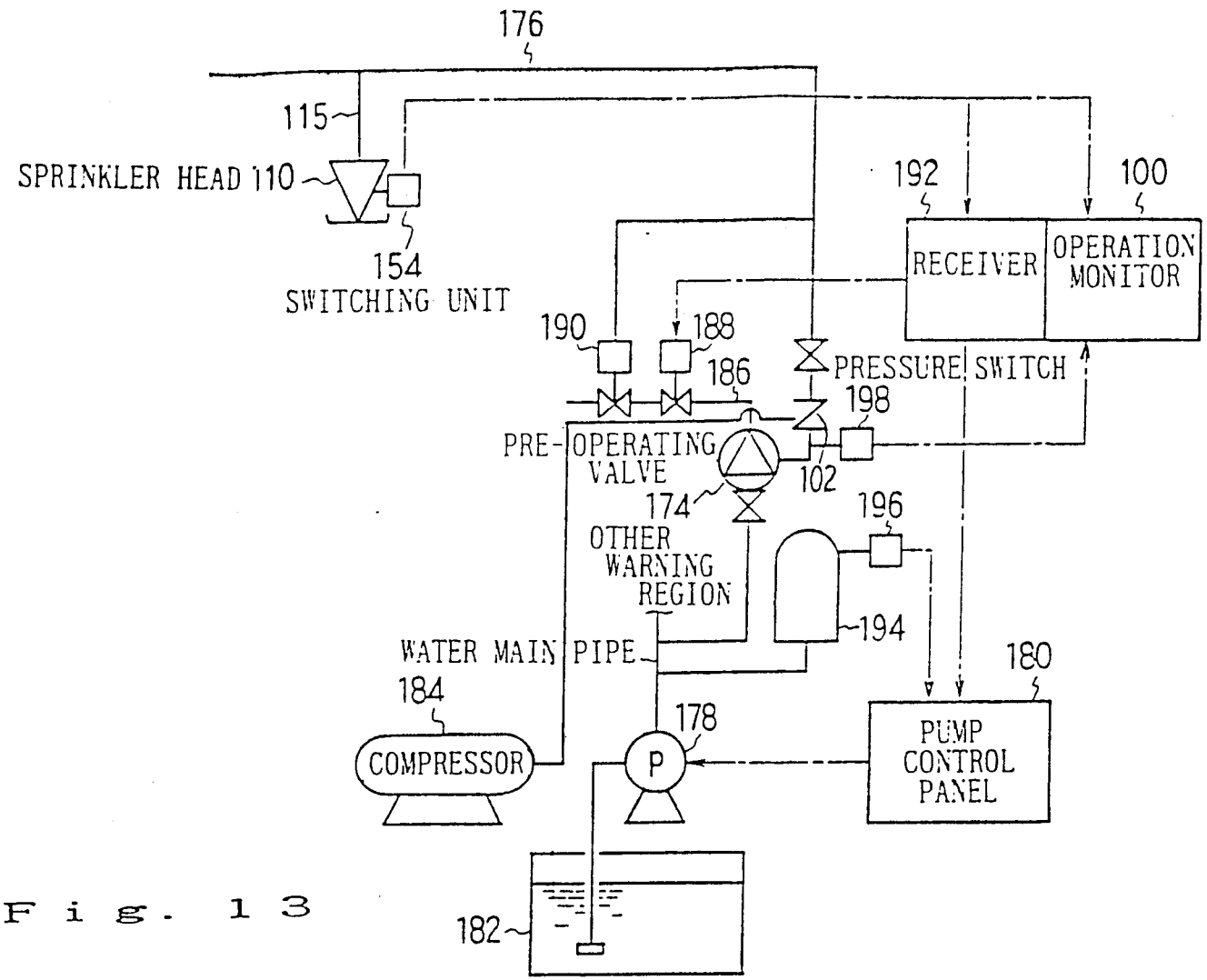
FIG. 13 is an explanatory view of pre-operating sprinkler equipment provided with an operation monitor for a sprinkler head of the present invention.

FIG. 13 is a drawing showing the arrangement of pre-operating sprinkler equipment which uses the sprinkler head 110 of the present invention shown in FIG. 7.

In FIG. 13, the sprinkler head 110 is connected to a branch pipe 176 on the secondary side of a pre-operating valve 174 through a down pipe 115. A water main pipe on the primary side of the pre-operating valve 174 is connected to a fire pump 178. The fire pump 178 is started and stopped by a pump control panel 180 and, when the pump is started, the firewater is supplied under pressure from a water source 182.

Compressed air is sent from a compressor 184, through a check valve 102, to the piping extending to the sprinkler head 110 on the secondary side of the pre-operating valve 174, the compressed air being charged and held in a steady monitor state.

The pre-operating valve 174 is opened by the solenoid valve 188 provided on a low-pressure starting piping 186 and a low-pressure operating pilot valve 190. The solenoid valve 188 is opened by the control signal output when a receiver 192 receives a fire detection signal from a switching unit 154 provided on the sprinkler head 110. The low-pressure operating pilot valve 190 is opened when it receives the pressure reduction in the branch pipe 176 which is caused by the operation of the sprinkler head 110 to discharge the compressed air from the pipe 176.

In addition, a pressure tank 194 is provided on the primary side of the pre-operating valve 174, i.e., the discharge side of the fire pump 178. The pressure tank 194 is provided with a pressure switch 196 for detecting a pressure reduction so that, when the pressure switch 196 is operated by the pressure reduction on the primary side, which is caused by opening the pre-operating valve 174, the pump control panel 180 starts the fire pump 178 on the basis of the signal output from the pressure switch 196. The pump control panel 180 can start and stop the pump 178 on the basis of the signal from the receiver 192.

An operation monitor 100 for the sprinkler head in accordance with the present invention is installed near the receiver 192. To the operation monitor 100 are connected a signal line from the switching unit 154 provided on the sprinkler head 110 and a signal line from the pressure switch 198 provided on the secondary side of the pre-operating valve 174 so as to serve as a water flow detector.

When the operation monitor 100 receives the sprinkler head operating signal from the switching unit 154 provided on the sprinkler head 110 and when it receives the water flow detection signal from the pressure switch 198, the monitor 100 decides that the sprinkler head 110 is operated and displays the operation thereof.

Namely, the switching unit 154 of the sprinkler head 110 outputs as the switch-on signal a fire detection signal when it detects a fire. If the firewater is then discharged by the operation of the sprinkler head 110, the switching unit 154 is returned to a non-operating state and outputs the switch-off signal as a sprinkler head operating signal. In the operation monitor 100, therefore, the fire detection signal (switch-on signal) is first obtained, the state wherein the sprinkler head operation signal (switch-off signal) is obtained is detected in a circuit manner, and the operation of the sprinkler head 110 is then displayed by carrying out AND of the sprinkler head operation signal and the water flow detection signal output from the pressure switch 198.

The operation of the pre-operating sprinkler equipment shown in FIG. 13 is described below.

If a fire breaks out in the place where the sprinkler head 110 is installed, the switching unit 154 first receives the heat generated by the fire and is turned on so as to output a fire detection signal to the receiver 192 and the operation monitor 100. When the receiver 192 receives the fire detection signal from the switching unit 154, the receiver 192 outputs a control signal to the solenoid valve 188 so as to open the solenoid valve 188.

If the temperature of the sprinkler head 110 is further increased, the sprinkler head 110 is operated so that the compressed air is discharged from the branch pipe 176 for reducing the pressure. The low-pressure operating pilot valve 190 is opened when receiving the pressure reduction in the branch pipe 176. Since the solenoid valve 188 has already been opened by the control signal from the receiver 192, the low-pressure starting piping 186 is opened. The pre-operating valve 174 is opened by the opening of the low-pressure starting piping 186. The pressure switch 198 is then operated to send a water flow alarm.

When the pre-operating valve 174 is opened, the pressure in the pressure tank 194 provided on the primary side is reduced. When the pressure switch 196 detects the pressure reduction, the fire pump 178 is started by an instruction from the pump control panel 180.

When the fire pump 178 is started, the firewater is supplied under pressure to the sprinkler head 110 from the water source 182 through the pre-operating valve 174, the branch pipe 176 and the down pipe 115 so that the firewater is discharged from the sprinkler head 110 operated.

When the firewater is discharged from the sprinkler head 110, the firewater is splashed, through the opening 155, on the switching unit 154 provided near the head 110 so that the switching unit 154 is cooled. As a result, the temperature of the switching unit 154 is decreased to the operating temperature so that the switching unit 154 is returned to the non-operating state, thereby establishing a switch-off state. Namely, the switching unit 154 outputs the sprinkler head operating signal. When the operation monitor 100 receives the sprinkler head operation signal from the switching unit 154, since the monitor 100 receives the water flow detection signal from the pressure switch 198 at the same time as the operation signal, the monitor 100 carries out AND of both signals and displays the operation of the sprinkler head 110.

On the other hand, when the switching unit 154 is operated by the temperature rise produced by a cause other than a fire, even if a fire detection signal is sent to the receiver 192, the sprinkler head 10 is not operated. Thus the low-pressure operating pilot valve 190 is not opened so that the wrong operation caused by the opening of the pre-operating valve 174 can be inhibited. Namely, double interlock is made by the solenoid valve 188 and the low-pressure operating pilot valve 190.

In addition, even when the switching unit 154 is turned on by the temperature rise produced by a cause other than a fire and then outputs the sprinkler head operation signal to the operation monitor 100 when being cooled and assuming a switch-off state, since no water flow detection signal is obtained from the pressure switch 198, it is possible to prevent the operation monitor 100 from mistakenly displaying the operation of the sprinkler head 110.

Although the above embodiment concerns as an example the pre-operating sprinkler head equipment, the present invention is not limited to this. The present invention can be applied to appropriate other sprinkler equipment such as wet sprinkler equipment in which firewater is charged under pressure in piping extending to the sprinkler head in a steady state of monitoring.

Although FIG. 7 shows an embodiment in which a low-temperature solder is used in the heat-sensitive assembling portion in the sprinkler head, the present invention can be applied to appropriate sprinkler heads of the type in which a glass tube is broken due to the expansion of the liquid sealed in the glass tube at the operating temperature, as in the first embodiment, the type which uses a shape memory alloy and the like.

Further, although the above-described embodiment uses the reverse bimetal 172 in the switching unit 154, an embodiment may use a shape memory alloy having bidirectional properties which allows the alloy to deform so as to close a contact at a fire temperature and then open it by cooling.

What is claimed is:

1. A sprinkler head comprising a cover plate which is operated to fall down at a temperature lower than the operating temperature of said sprinkler head body, wherein:

switching means is provided for detecting the falling of said cover plate and sending a fire detection signal to said sprinkler head body.

2. A sprinkler head according to claim 1, wherein said cover plate comprises a cover plate body, a synthetic resin piece for engaging said cover plate with said sprinkler head body and a metal plate fixed to said cover plate by a heat resistant adhesive and fixed to said cover plate body by a low-temperature solder.

3. A sprinkler head according to claim 1, wherein said cover plate comprises a cover plate body, a synthetic resin piece for engaging said cover plate with said sprinkler head body, and a spring plate engaged with said synthetic resin piece and fixed to said cover plate by low-temperature solder, a compression spring being interposed between said cover plate and said synthetic resin piece so as to be urged in the direction in which said cover plate is separated from said synthetic resin piece.

4. A sprinkler head according to claim 1, wherein said cover plate comprises a cover plate body and an engaging piece made of a shape memory alloy which is fixed to said cover plate so as to engage with said sprinkler head body at a normal temperature and released from the engagement with said sprinkler body when the temperature is increased.

5. A sprinkler head comprising switching means provided on a side of the sprinkler head body so as to send a fire detection when said means is operated at a temperature lower than the operating temperature of said sprinkler head and a sprinkler head operation signal when said means is returned to a non-operating state by detection of the firewater discharged by the operation of said sprinkler head after said fire detection signal has been sent.

6. An operation monitor for a sprinkler head comprising switching means provided on the side of the sprinkler head body so as to send a fire detection when said means is operated at a temperature lower than the operating temperature of said sprinkler head and a sprinkler head operation signal when said means is returned to a non-operating state by the detection of the firewater discharged by the operation of said sprinkler head after said fire detection signal has been sent, wherein:

when said monitor receives said sprinkler head operation signal from said switching means provided on said sprinkler head and said detection signal from a water flow detector provided in piping of said sprinkler head, said monitor decides that said sprinkler head is operated and indicates the operation.

* * * * *